US008348202B2

(12) United States Patent
Franke

(10) Patent No.: US 8,348,202 B2
(45) Date of Patent: Jan. 8, 2013

(54) RAILROAD SWITCH MACHINE

(75) Inventor: Raymond C. Franke, Glenshaw, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 647 days.

(21) Appl. No.: 12/193,221

(22) Filed: Aug. 18, 2008

(65) Prior Publication Data

US 2009/0308985 A1 Dec. 17, 2009

Related U.S. Application Data

(60) Provisional application No. 61/061,001, filed on Jun. 12, 2008.

(51) Int. Cl.
*B61L 11/08* (2006.01)

(52) U.S. Cl. ..... 246/242 R

(58) Field of Classification Search ..... 246/132, 246/134, 218, 221, 225, 226; 318/280–286
See application file for complete search history.

(56) References Cited

U.S. PATENT DOCUMENTS 3,696,244 A * 10/1972 Hamley et al. ..... 246/242 R
5,494,242 A 2/1996 Ludwick et al.
5,504,405 A 4/1996 Hager
5,582,370 A 12/1996 Myers et al.
5,586,737 A 12/1996 Van Alstine et al.
5,669,587 A 9/1997 Van Alstine et al.
5,671,348 A 9/1997 Petit
5,919,237 A 7/1999 Balliet
6,009,554 A 12/1999 Balliet
6,300,734 B1 10/2001 Franke et al.
6,366,041 B1 * 4/2002 Bozio et al. ..... 318/280
6,484,974 B1 11/2002 Franke et al.
6,494,409 B1 12/2002 Franke

* cited by examiner

*Primary Examiner* — Robert McCarry, Jr.

(74) *Attorney, Agent, or Firm* — Eckert Seamans Cherin & Mellott, LLC; Philip E. Levy

(57) ABSTRACT

A switch machine that includes a first relay having first normally open contacts and first normally closed contacts provided in the normal motor connection path and a second relay having second normally open contacts and second normally closed contacts provided in the reverse motor connection path. The normally open and closed contacts of each relay are associated in pairs and the first relays are structured such that each normally closed contact and the corresponding normally open contact cannot be simultaneously closed. Also, a method of protecting a motor of a switch machine that includes integrating a current being drawn by the motor and opening a motor circuit that includes the motor if the integrated current exceeds a threshold.

15 Claims, 3 Drawing Sheets

RAILROAD SWITCH MACHINE

CROSS-REFERENCE TO RELATED APPLICATIONS

This application claims the benefit of U.S. Provisional Application No. 61/061,001, entitled "Biased Neutral Controller for M23E Switch Machine", filed on Jun. 12, 2008, the disclosure of which are incorporated herein by reference.

FIELD OF THE INVENTION

The present invention relates to railroad switch machines, and in particular to a railroad switch machine employing a set of interlocking relays and/or methods for protecting the switch machine against contact welding and thermal damage.

BACKGROUND OF THE INVENTION

Switch machines are used to move a portion of track at a switch point in a railway system to switch a train from one track to another. It is commonplace for personnel controlling switch machines to be located hundreds or even thousands of miles away from the locations of switch points at which the switch machines are installed such that they cannot observe the operation of the switch machine with their own eyes. Such personnel must remotely control such switch machines via control signals sent to those locations, and they must rely on indicator signals sent back from sensors at those locations to tell them when a switch machine has completed a given track switching operation.

Such remote operation, therefore, makes the reliability of switch machines and the ability to be certain of the status of the tracks at switch points at any given time of great importance. Of all of the possible scenarios for a malfunction of a switch machine, the one that railroad operators most wish to avoid is a control malfunction causing the switch machine to suddenly change the position of a portion of track at a switch point just at the moment where a train is approaching the switch point such that it is too late for the train to stop before reaching the switch point with the result that the train is derailed.

As is known in the art, electromechanical switching devices (vital relays or contactors) are used for the control of switch machines. These devices are of such a design and construction to preclude malfunction and related movement of points. Erosion of contacts in a relay employed in current switch machines can occur when arcing takes place between a moving contact and a stationary contact as the moving contact moves into or out of engagement with the stationary contact. Contact erosion is the result of there being a large amount of electrical current being switched by the relay, which is the case in a switch machine since the motor required to move a portion of track between two switch positions is typically a large motor requiring a great deal of power. With current state of the art there is no mitigation of arcing and resultant contact erosion and thus the switching devices must be replaced periodically. However, the controls are consistent with prevention that could cause the points to move opposite to the intended direction. Although indicator lights at the switch point will warn the train engineer operating the train that the switch point has suddenly started moving the portion of track again, trains are typically unable to stop very quickly, and the train engineer may not be able to stop his train soon enough to avoid derailment or collision. Therefore it is imperative to maintain that security with any new control scheme.

Another issue affecting reliability of switching machines is an occasion in which the movement of a portion of track from one switch position to another cannot be completed because of either a mechanical malfunction or an obstruction preventing the portion of track from moving to the new switch position. In such situations, there is the risk of damaging the motor of the switch machine if the motor is allowed to continue struggling to move the portion of track. It is typical to employ a second relay configured to cut the power to the motor in such a circumstance. A resistor with a high temperature coefficient is coupled in parallel with the actuating coil of the second relay that causes the second relay to trip in response to the motor suddenly drawing more current for a protracted time. Such a use of a relay is effective, but adds considerably to the cost of the switching machine.

SUMMARY OF THE INVENTION

In one embodiment, a switch machine for moving a set of railroad points is provided. The switch machine includes a motor that is operatively coupled to the points for selectively moving the points. The motor is also operatively coupled to a power supply through a normal connection path and a reverse connection path. The motor is structured to be selectively driven in a normal direction for moving the points toward a normal position when power is applied thereto by the power supply through the normal connection path and in a reverse direction when power is applied thereto by the power supply through the reverse connection path. The switch machine further includes a first relay having one or more first normally open contacts and one or more first normally closed contacts provided in the normal connection path and a second relay having one or more second normally open contacts and one or more second normally closed contacts provided in the reverse connection path. Each of the one or more first normally open contacts is associated with a corresponding one of the one or more first normally closed contacts, and similarly, each of the one or more second normally open contacts is associated with a corresponding one of the one or more second normally closed contacts. The first relay is structured such that each first normally closed contact and the corresponding first normally open contact cannot be simultaneously closed and the second relay is structured such that each second normally closed contact and the corresponding second normally open contact cannot be simultaneously closed.

In the preferred embodiment, the first relay is polarized and responds only to a first polarity being applied thereto by a control system and the second relay is polarized and responds only to a second polarity opposite the first polarity being applied thereto by the control system. Furthermore, the one or more second normally closed contacts are operatively coupled to the first relay, the one or more first normally closed contacts are operatively coupled to the second relay, wherein the first relay will be energized in response to the first polarity only if each of the one or more second normally closed contacts is closed, and wherein the second relay will be energized in response to the first polarity only if each of the one or more first normally closed contacts is closed. When the first relay is successfully energized, each of the one or more first normally closed contacts will be caused to open and each of the one or more first normally open contacts will be caused to close, and when the second relay is successfully energized, each of the one or more second normally closed contacts will be caused to open and each of the one or more second normally open contacts will be caused to close.

In addition, in the preferred embodiment the normal connection path includes a first electronic switch, and the reverse connection path includes a second electronic switch, wherein the first electronic switch is operatively coupled to first control logic and is turned on only in response to the first control logic receiving both a first signal in response to the first relay being successfully energized and a second signal indicating that the points are in the normal position, and wherein the second electronic switch is operatively coupled to second control logic and is turned on only in response to the second control logic receiving both a third signal in response to the second relay being successfully energized and a fourth signal indicating that the points are in the reverse position. Most preferably, the first control logic includes a first delay control, and the second control logic includes a second delay control, wherein the first electronic switch is caused to be turned on by the first delay logic a predetermined time after the first control logic receives both the first signal and the second signal, and wherein the second electronic switch is caused to be turned on by the second delay logic a predetermined time after the second control logic receives both the third signal and the fourth signal. Also, the first relay is operatively coupled to a first solid sate relay, and the second relay is operatively coupled to a second solid sate relay, wherein the first solid state relay is turned on and the first signal is generated in response to the first relay being successfully energized, and wherein the second solid state relay is turned on and the third signal is generated in response to the second relay being successfully energized.

In another embodiment, a method of protecting a motor of a switch machine is provided that includes integrating a current being drawn by the motor, determining whether the integrated current has reached a predetermined threshold, and if it is determined that the integrated current has reached the predetermined threshold, opening a motor circuit of the switch machine that includes the motor. The integrating step may comprise obtaining a voltage that is proportional to the current and providing the voltage to an integrator, and the determining step may comprise determining whether an output of the integrator reaches a bias point, wherein the motor circuit is opened if the output reaches the bias point.

In still another embodiment, a switch machine is provided for moving a set of railroad points. The switch machine includes a motor that is operatively coupled to the points for selectively driving the points, and a plurality of polarized relays operatively coupled to the motor. The plurality of polarized relays are responsive to a bi-polar control signal received from a control system, wherein a polarity of the bi-polar control signal indicates a desired direction for driving the points. The plurality of polarized relays are interlocked with one another in a manner that prevents the motor from driving the points in a direction that is inconsistent with the polarity of the bi-polar control signal.

In yet another embodiment, a switch machine for moving a set of railroad points is provided that includes a motor that is operatively coupled to the points for selectively moving the points and to a power supply through a connection path, and a relay having one or more normally open contacts provided in the connection path, wherein the relay is responsive to a control signal received from a control system. When the relay is caused to be energized in response to the control signal thereby causing the one or more normally open contacts to close, the connection path will be open and will be caused to remain open for a predetermined time thereafter such that said one or more normally open contacts will close against an open circuit, and when the relay is caused to be de-energized in response to the control signal thereby causing said one or more normally open contacts to open, the connection path will be open such that the one or more normally open contacts will open against an open circuit.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DESCRIPTION OF THE PREFERRED EMBODIMENTS

Figure 1A:
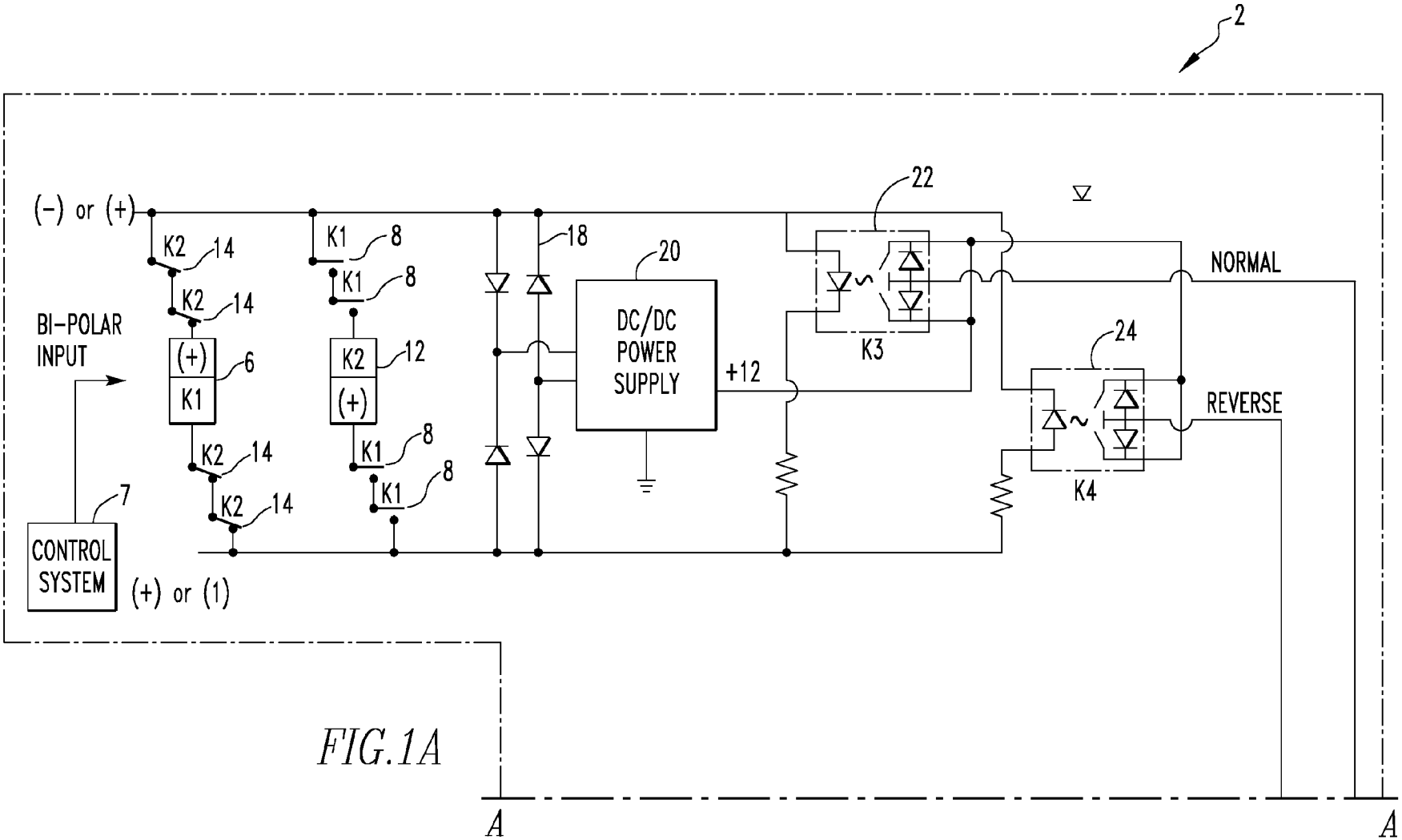
FIGS. 1A, 1B and 1C are a schematic diagram of a switch machine according to one embodiment of the present invention.

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

As employed herein, the statement that two or more parts or components are "coupled" together shall mean that the parts are joined or operate together either directly or through one or more intermediate parts or components.

As employed herein, the statement that two or more parts or components "engage" one another shall mean that the parts exert a force against one another either directly or through one or more intermediate parts or components.

As employed herein, the term "number" shall mean one or an integer greater than one (i.e., a plurality).

Figure 1B:
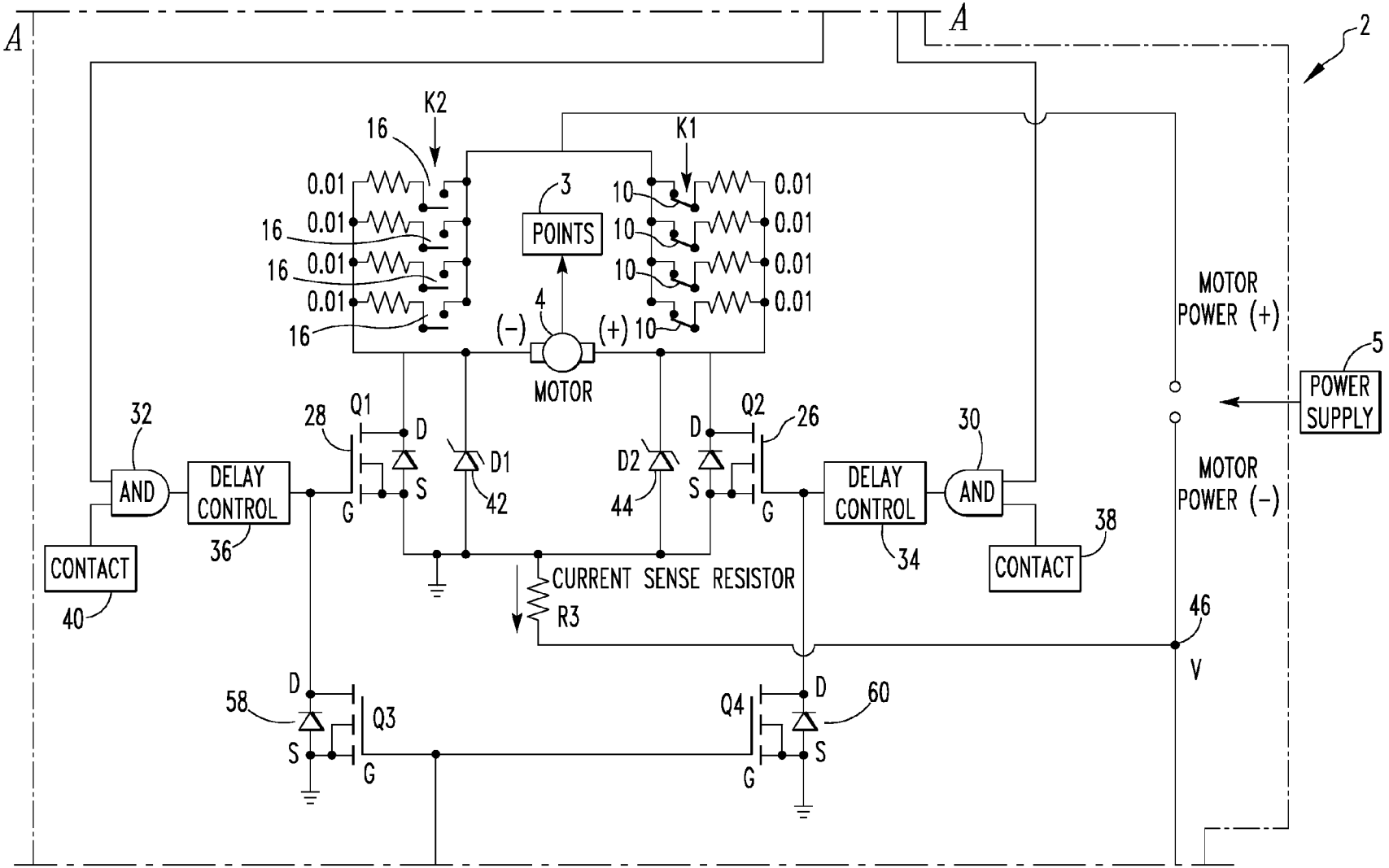
Figure 1C:
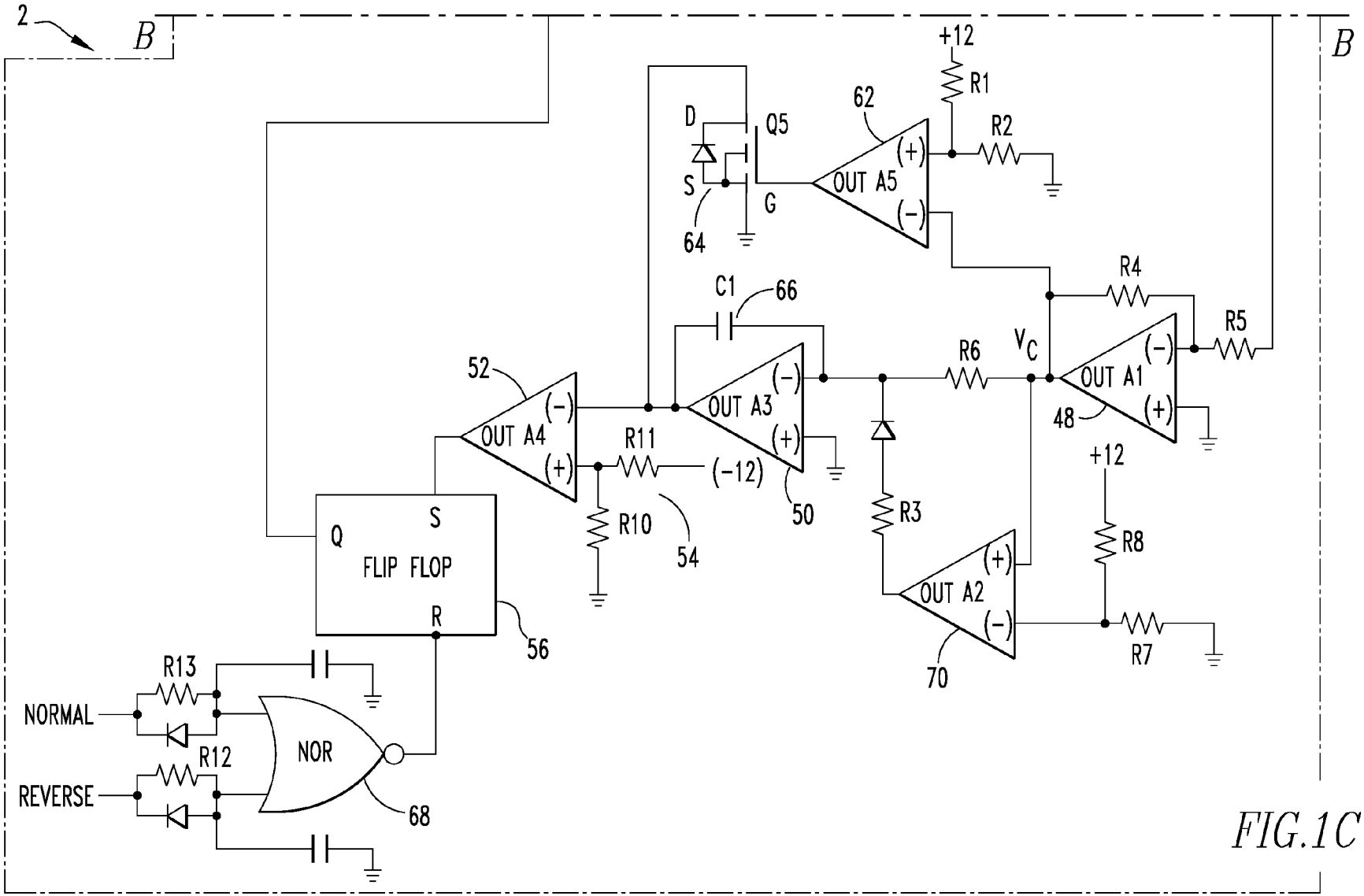

FIGS. 1A, 1B and 1C are a schematic diagram of a switch machine 2 according to one embodiment of the present invention. As is known in the art, a railroad turnout or points are a mechanical installation enabling railway trains to be guided from one track to another at a railway junction. In particular, points consist of a pair of linked rails lying between diverting outer rails. These linked rails can be moved laterally into one of two positions, a normal position and a reverse position, so as to determine whether a train approaching the points will be led toward a straight path or toward a diverging path. When the points are in the normal position, the train will be led toward the straight path, and when the points are in the reverse position, the train will be led toward the diverging path. The switch machine 2 shown in FIGS. 1A, 1B and 1C is structured to selectively move a set of points 3 between a normal position and a reverse position.

The switch machine 2 includes a motor 4 driven by a power supply 5 wherein the motor 4 is operatively coupled to the points 3 in order to move the points 3 between the normal and reverse positions. The switch machine 2 includes a force guided relay 6 having four independent normally closed contacts 8 and four independent normally open contacts 10 arranged in corresponding pairs. The relay 6 is structured such that the normally closed contact 8 and the normally open contact 10 in an associated pair can never be simultaneously closed. In other words, if one of the contacts 8, 10 in a pair is closed, the other of the contacts in that pair cannot also be closed, and instead must be open. The switch machine 2 also includes a second force guided relay 12 that is identical in structure and operation to the force guided relay 6 and includes four normally closed contacts 14 and four normally open contacts 16 arranged in associated pairs.

When the relay 6 is energized with the proper polarity, the normally closed contacts 8 will be caused to open and the normally open contacts 10 will be caused to close. Similarly, when the relay 12 is energized with the proper polarity, the normally closed contacts 14 will be caused to open and the normally open contacts 16 will be caused to close. As seen in FIGS. 1A, the relay 6 and the relay 12 are operatively coupled to a control system 7, such as, for example and without limitation, the Micro Lok® System sold by the Assignee of the present invention, which provides a bi-polar input to the relays 6 and 12 as shown in FIG. 1A. The bi-polar input comprises a first polarity and a second polarity, and the particular polarity that is applied will, as described in greater detail elsewhere herein, determine the direction in which the motor 4 is driven. In addition, each of the relays 6 and 12 is polarized, meaning that it will respond to only a specific polarity. The relays 6 and 12 are arranged such that the relay 6 will be energized when the first polarity is applied thereto and not energized when the second polarity is applied thereto, and the relay 12 will be energized when the second polarity is applied thereto and will not be energized when the first polarity is applied thereto.

The switch machine 2 also includes a bridge rectifier 18 operatively coupled to a DC/DC power supply 20. Further, the switch machine 2 includes a first solid state relay 22 and a second solid state relay 24. The first and second solid state relays 22 and 24 are configured such that the solid state relay 22 will be turned on only when the relay 6 is energized (also referred to as being "picked up") and the solid state relay 24 will be turned on only when the relay 12 is energized or picked up.

When the relay 6 and the relay 12 are configured as shown in FIGS. 1A, 1B and 1C, the relay 6 cannot be energized or picked up in response to the application of the appropriate polarity (the first polarity) unless all of the normally closed contacts 14 of the relay 12 are closed. Similarly, in order for the relay 12 to be energized or picked up in response to the application of the appropriate polarity (the second polarity), all of the normally contacts 8 of the relay 6 must be closed. Furthermore, when all of the normally closed contacts 14 of the relay 12 are closed, that means that all of the normally open contacts 16 of the relay 12 must be open, and similarly when all of the normally closed contacts 8 of the relay 6 are closed, that means that all of the normally open contacts 10 of the relay 6 must be open.

As described in greater detail elsewhere herein, this configuration ensures that once a particular polarity is established by the control system 7, that polarity will dictate the only direction in which the motor 4 is able to rotate. In other words, the configuration of the relays 6 and 12 as shown in FIGS. 1A, 1B and 1C guarantees that the direction of the motor 4 will always coincide with the intended direction as indicated by the particular polarity of the bi-polar input. Thus, the switch machine 2 is able to be controlled directly from the control system 7 without the need to employ any vital relays as were required in prior art switch machine. This is advantageous as vital relays are expensive and need to be tested and replaced periodically.

As seen in FIG. 1B, the switch machine 2 includes a first field effect transistor (FET) 26 operatively coupled to a first end of the motor 4 and a second field effect transistor (FET) 28 operatively coupled to the second end of the motor 4. Furthermore, the switch machine 2 includes an AND gate 30 coupled to a time delay control 34 and an AND gate 32 coupled to a time delay control 36. The time delay control 34 and the time delay control 36 each independently outputs a signal a predetermined amount of time after receiving an active (i.e., logic high or a "1") signal from the corresponding AND gate 30,32. Furthermore, the output of the time delay control 34 is coupled to the gate of the FET 26 and the output of the time delay control 36 is coupled to the gate of the FET 28. The active output signal from the time delay control 34 will cause the FET 26 to turn on and similarly the active output signal from the time delay control 36 will cause the FET 28 to turn on.

The output of the solid state relay 22 is input into the first input of the AND gate 30 and the output of the solid state relay 24 is input into the first input of the AND gate 32. In addition, a contact 38 is operatively coupled to the second input of the AND gate 30 such that a voltage signal will be applied to the AND gate 30 when the contact 38 is closed. The contact 38 is operatively coupled to the rods which move the points 3 such that the contact 38 will be closed when the points 3 are in a reverse position and open when the points 3 are in a normal position. Similarly, a contact 40 is operatively coupled to the second input of the AND gate 32 such that a voltage signal will be applied to the AND gate 32 when the contact 40 is closed. The contact 40 is operatively coupled to the rods which move the points 3 such that the contact 40 will be closed when the points 3 are in a normal position open when the points 3 are in a reverse position.

As seen in FIGS. 1A, 1B and 1C, the power provided to the motor 4 by the power supply 5 will have one of two paths depending upon which of the two FETs 26 and 28 is turned on and which of the two relays (6 or 12) is energized. A first path, which will cause the motor 4 to move the points 3 toward a normal position, passes through the normally open contacts 16 of the relay 12 through the motor 4 and through the FET 26. A second path which will cause the motor 4 to move in the opposite direction and thus move the points 3 toward a reverse position passes through the normally open contacts 10 of the relay 6 through the motor 4 and through the FET 28.

The operation of the switch machine 2 will now be described. Assume that the switch machine 2 had been previously driven to a normal position. As discussed elsewhere herein, this is done by the control system 7 providing the bi-polar input having the second polarity which will have caused the relay 12 to be energized and the relay 6 to not be energized as a result of the polarization of those relays. In the driven normal position, the normally closed contacts 8 of the relay 6 are closed, the normally open contacts 10 of the relay 6 are open, the normally closed contacts 14 the relay 12 are open, and the normally open contacts 16 of the relay 12 are closed. In addition, the solid state relay 22 is on and the solid state relay 24 is off. The contact 38 will be open and the contact 40 will be closed because the points 3 are in a normal position. Finally, both FET 26 and FET 28 will be off because neither AND gate 30 nor AND gate 32 will be outputting an active signal.

If it is desired to move the points 3 to the reverse position, the control system 7 will first reverse the polarity of the bi-polar input and thereby provide the second polarity. This change in polarity will result in the relay 12 no longer being energized, which will, under normal conditions, cause the normally closed contacts 14 to close and the normally open contacts 16 to open. If and only if all of the normally closed contacts 14 of the relay 12 are in fact closed, meaning that all of the corresponding normally open contacts 16 of the relay 12 are in fact open, this change in polarity will cause the relay 6 to be energized. The energizing of the relay 6 will, under normal conditions, cause the normally closed contacts 8 of the relay 6 to open and the normally open contacts 10 of the relay 6 to close. If, however, any of the normally open contacts 16 of the relay 12 remain closed at this point, such as, for example, due to one or more of those normally open contacts 16 being welded, then that means that the corresponding normally closed contact 14 in the pair will not be able to close. In such a situation, the relay 6 will not be able to be energized notwithstanding the reverse in polarity, and thus, as described elsewhere herein, the switch machine will be prohibited from moving in the requested direction.

If as a result of the change in polarity the relay 12 is able to be de-energized and the relay 6 is able to be successfully energized, this will result in the solid state relay 22, which was previously turned on, being turned off and the solid state relay 24, which was previously turned off, being turned on (the solid state relays 22 and 24 are not interlocked, but instead are independent and depend on the particular signals provided thereto). As a result, a voltage will no longer be provided to the AND gate 30, thus causing the AND logic to fail. In addition, because the solid state relay 24 is on, a voltage signal will be provided to the first input of the AND gate 32. Because the logic at the AND gate 30 outputs a zero value, the FET 26 will no longer be turned on, but instead will be turned off, thereby opening the motor path that includes the FET 26. As described elsewhere herein, if the points 3 are in a normal position, the contact 40 will be closed and as a result a voltage will be provided to the first input of the AND gate 32. Because the AND gate 32 will have received a voltage at both of its inputs, it will output a logic 1. That logic 1 is input into the time delay control 36 which causes a timer to start to run. After the timer expires, i.e., after the time delay ends, the time delay control 36 will output a voltage to the gate of the FET 28, thereby causing the FET 28 to be turned on. At this point, the normally open contacts 10 will be closed and the FET 28 will be on. As a result, the path including the FET 28 will be complete and power will be applied to the motor 4 by the power supply 5 through that path, causing the motor to move in the reverse direction.

It is important to note that, due to this time delay, the normally open contacts 10 of the relay 6 will have had time to close and settle before the voltage is applied to the gate of the FET 28 thereby completing that path through the motor 4. As a result, the normally open contacts 10 of the relay 6 will be ensured to close against an open circuit. It is only after the normally open contacts 10 have closed and stabilized that the FET 28 is turned on, and thus the normally open contacts 10 are not stressed by the combination of motor in-rush current occurring while the normally open contacts 10 are as yet not stabilized to a low ohmic conducting state.

Once the motor 4 is finished moving the points 3 to the reverse position (end of stroke), the contact 40 will open, and a result the AND gate 32 will no longer output a logic 1, the FET 36 will turn off, and the motor path including the FET 28 will open. At this point, both motor paths will be open. Thus, when the switch machine 2 moves again as a result of a change in polarity, the normally open contacts 10 will open against an open circuit, thereby reducing the chance of arcing that might cause those contacts to weld. In addition, the opening of both motor paths is an interrupt to the motor power circuit which causes instantaneous polarity reversal in the motor terminals. If not compensated for, this can cause problems. Thus, transorbs 42 and 44 are provided through which stored energy can dissipate.

It will be appreciated that operation of the switch machine 2 as just described will be similar for a move from driven reverse to normal. In such a case, the role and function of each of the corresponding components just described will be reversed, with similar beneficial results being obtained.

As noted elsewhere herein, most switch machines are operated remotely by a dispatcher that cannot see the switch machine. In some instances, the machine may stall due to an obstruction. In such a case, it is important to thermally protect the motor of the switch machine from drawing excessive current for a prolonged time.

According to an aspect of the present invention, the motor 4 is protected from drawing excessive current for a protracted time by integrating current and upon reaching a specific threshold voltage, preferably representing a product of 500 ampere seconds, the motor circuit is opened. In particular, a voltage V that is proportional to the current in the motor 4 is present at node 46. That voltage is provided to a gain stage 48 that outputs a voltage $V_c$. The voltage $V_c$ is provided to an integrator 50. The output of the integrator 50 is a negatively increasing voltage. Specifically, the current input into the integrator 50 is equal to the rate of change of the voltage at the output of the integrator 50. The negatively increasing voltage output by the integrator 50 is provided to the (−) input of an amplifier 52. The (+) input of the amplifier 52 is biased at a negative voltage by the divider 54 (provided by R10/R11) and the output of the amplifier 52 is normally negative. When the output of the integrator 50 reaches the negative bias point of the amplifier 52, the output of the amplifier 52 switches to positive. This change from negative to positive causes the output of a flip flop 56, which coupled to the output of the amplifier 52, to go high. The output of the flip flop 56 is coupled to the gates of FETs 58 and 60, which are normally off. The drains of FETs 58 and 60 are coupled to the FETS 26, 28 as shown in FIG. 1B. When the output of the flip flop 56 goes high as just described, the FETs 58 and 60 will turn on, which pulls either FET 26 or FET 28 out of conduction, thereby opening the motor circuit. The motor 4 will thus be protected from excessive heating.

When, as a result of the above, the current of the motor 4 goes to zero, amplifier 62 will switch high, which in turn turns on the FET 64. When the FET 64 turns on, the capacitor 66 of the integrator 50 shorts, thereby draining the integrator and getting it set for another cycle. In addition, once a current overload has been reached as just described, the flip flop 56 needs to be reset for the next cycle. This is accomplished by reversing the polarity of the bipolar input described elsewhere herein. The NOR gate 68 responds to such a reverse in polarity by delivering a short (+) pulse to the flip flop 56, making its output low, which in turn turns the FETS 58 and 60 off. The polarity reversal will then drive the motor 4 in the opposite direction as described elsewhere herein.

In addition, an amplifier 70 is provided and is biased negative via the divider 72 (R7/R8). The switch machine 2 is provided with a clutch (not shown) which allows slippage in the drive mechanism while the switch machine 2 is stalled. The amplifier 70 is set to switch positive whenever the motor current exceeds that to which the clutch is adjusted. If the clutch were to stick, with the switch machine 2 obstructed, motor current will increase significantly and the amplifier 70 will switch positive, thereby delivering additional current to the integrator 50. The value of the resistor 74 (R9) is significantly less than the value of the resistor 76 (R5), and as a result, the output of the integrator 50 will increase negatively much faster and open the motor circuit is a disproportionately shorter time.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A switch machine for moving a set of railroad points, comprising:

a motor, said motor being operatively coupled to said points for selectively moving said points, said motor being operatively coupled to a power supply through a normal connection path and a reverse connection path, said motor being structured to be selectively driven in a normal direction for moving said points toward a normal position when power is applied thereto by said power supply through said normal connection path and in a reverse direction when power is applied thereto by said power supply through said reverse connection path;

a first relay having one or more first normally open contacts and one or more first normally closed contacts, said one or more first normally open contacts being provided in said normal connection path, each of said one or more first normally open contacts being associated with a corresponding one of said one or more first normally closed contacts; and a second relay having one or more second normally open contacts and one or more second normally closed contacts, said one or more second normally open contacts being provided in said reverse connection path, each of said one or more second normally open contacts being associated with a corresponding one of said one or more second normally closed contacts;

wherein said first relay is structured such that each first normally closed contact and the corresponding first normally open contact cannot be simultaneously closed and said second relay is structured such that each second normally closed contact and the corresponding second normally open contact cannot be simultaneously closed.

2. The switch machine according to claim 1, wherein said first relay is a polarized relay and responds only to a first polarity signal being applied thereto by a control system and wherein said second relay is a polarized relay and responds only to a second polarity signal opposite said first polarity signal being applied thereto by said control system.

3. The switch machine according to claim 2, wherein said one or more second normally closed contacts are operatively coupled to said first relay, wherein said one or more first normally closed contacts are operatively coupled to said second relay, wherein said first relay will be energized in response to said first polarity signal only if each of said one or more second normally closed contacts is closed, and wherein said second relay will be energized in response to said second polarity signal only if each of said one or more first normally closed contacts is closed.

4. The switch machine according to claim 3, wherein when said first relay is successfully energized, each of said one or more first normally closed contacts will be caused to open and each of said one or more first normally open contacts will be caused to close, and wherein when said second relay is successfully energized, each of said one or more second normally closed contacts will be caused to open and each of said one or more second normally open contacts will be caused to close.

5. The switch machine according to claim 3, wherein said normal connection path includes a first electronic switch, wherein said reverse connection path includes a second electronic switch, wherein said first electronic switch is operatively coupled to first control logic and is turned on only in response to said first control logic receiving both a first signal in response to said first relay being successfully energized and a second signal indicating that said points are in said normal position, and wherein said second electronic switch is operatively coupled to second control logic and is turned on only in response to said second control logic receiving both a third signal in response to said second relay being successfully energized and a fourth signal indicating that said points are in said reverse position.

6. The switch machine according to claim 5, wherein said first control logic includes a first delay control, wherein said second control logic includes a second delay control, wherein said first electronic switch is caused to be turned on by said first delay logic a predetermined time after said first control logic receives both said first signal and said second signal, and wherein said second electronic switch is caused to be turned on by said second delay logic a predetermined time after said second control logic receives both said third signal and said fourth signal.

7. The switch machine according to claim 6, wherein said first relay is operatively coupled to a first solid sate relay, wherein said second relay is operatively coupled to a second solid sate relay, wherein said first solid state relay is turned on and said first signal is generated in response to said first relay being successfully energized, and wherein said second solid state relay is turned on and said third signal is generated in response to said second relay being successfully energized.

8. The switch machine according to claim 1, wherein said first relay and said second relay are each a force guided relay.

9. A method of protecting a motor of a switch machine, comprising:

integrating a current being drawn by said motor to obtain a value representing an integrated current of said motor;

determining whether the value representing the integrated current has reached a predetermined threshold, the predetermined threshold being a product of time and current; and if it is determined that the value representing the integrated current has reached said predetermined threshold, opening a motor circuit of said switch machine that includes said motor.

10. The method according to claim 9, wherein said integrating comprises obtaining a voltage that is proportional to the current and providing said voltage to an integrator, and wherein said determining comprises determining whether an output of the integrator reaches a bias point, wherein said motor circuit is opened if said output reaches said bias point.

11. The method according to claim 9, wherein said opening comprises causing an electronic switch in said motor circuit to be turned off.

12. A switch machine for moving a set of railroad points, comprising:

a motor, said motor being operatively coupled to said points for selectively driving said points; and a plurality of polarized relays operatively coupled to said motor, each of said polarized relays being structured to respond to only a specific polarity signal, said plurality of polarized relays being responsive to a bi-polar control signal received from a control system, the bi-polar control signal having a polarity comprising either a first polarity or a second polarity opposite the first polarity, wherein the polarity of said bi-polar control signal indicates a desired direction for driving said points, and wherein said plurality of polarized relays are interlocked with one another in a manner that prevents said motor from driving the points in a direction that is inconsistent with the polarity of said bi-polar control signal.

13. A switch machine for moving a set of railroad points, comprising:

a motor, said motor being operatively coupled to said points for selectively moving said points, said motor being operatively coupled to a power supply through a connection path;

a relay having one or more normally open contacts provided in said connection path, said relay being responsive to a control signal received from a control system; and an electronic switch provided in said connection path;

wherein when said relay is caused to be energized in response to said control signal thereby causing said one or more normally open contacts to close, said power supply will be turned on and said electronic switch will be turned off and will be caused to remain off with said power supply turned on for a predetermined time thereafter such that said one or more normally open contacts will close against an open circuit, and wherein when said relay is caused to be de-energized in response to said control signal thereby causing said one or more normally open contacts to open, said electronic switch will be turned off with said power supply turned on such that said one or more normally open contacts will open against an open circuit.

14. The switch machine according to claim 13, wherein said electronic switch is operatively coupled to control logic having a delay control and wherein said electronic switch is turned on (i) only in response to said control logic receiving both a first signal in response to said relay being successfully energized and a second signal indicating that said points are in predetermined position, and (ii) only when said predetermined time has elapsed after said control logic receives both said first signal and said second signal.

15. The switch machine according to claim 14, wherein said relay is operatively coupled to a solid sate relay, and wherein said solid state relay is turned on and said first signal is generated in response to said relay being successfully energized.

* * * * *

UNITED STATES PATENT AND TRADEMARK OFFICE

CERTIFICATE OF CORRECTION

PATENT NO. : 8,348,202 B2
APPLICATION NO. : 12/193221
DATED : January 8, 2013
INVENTOR(S) : Raymond C. Franke It is certified that error appears in the above-identified patent and that said Letters Patent is hereby corrected as shown below:

In the Specification
Column 1, line 9, “are” should read --is--.
Column 3, line 22, “sate” should read --state--.
Column 3, line 23, “sate” should read --state--.
Column 4, line 21, “are a schematic diagram” should read --are schematic diagrams--.
Column 4, line 43, “are a schematic diagram” should read --are schematic diagrams--.
Column 5, line 14, “FIGS. 1A” should read --FIG. 1A--.
Column 5, line 46, “normally contacts 8” should read --normally closed contacts 8--.
Column 6, line 30, “normal position open” should read --normal position and open--.
Column 6, line 52, “contacts 14 the relay” should read --contacts 14 of the relay--.
Column 7, line 56, “a result the” should read --as a result the--.
Column 8, line 66, “circuit is a disproportionately” should read --circuit in a disproportionately--.

In the Claims
Column 10, line 26, “sate” should read --state--.
Column 10, line 28, “sate” should read --state--.
Column 12, line 18, “sate” should read --state--.

Signed and Sealed this
Fourth Day of June, 2013

Teresa Stanek Rea
*Acting Director of the United States Patent and Trademark Office*